US007753735B2

(12) United States Patent
Kudo et al.

(10) Patent No.: US 7,753,735 B2
(45) Date of Patent: Jul. 13, 2010

(54) FUSE BLOCK

(75) Inventors: Toshiharu Kudo, Makinohara (JP); Kenya Takii, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/491,317

(22) Filed: Jun. 25, 2009

(65) Prior Publication Data

US 2010/0022134 A1 Jan. 28, 2010

(30) Foreign Application Priority Data

Jul. 28, 2008 (JP) ..... 2008-193274

(51) Int. Cl.
*H01R 13/68* (2006.01)

(52) U.S. Cl. ..... 439/620.27

(58) Field of Classification Search ..... 439/620.27, 439/620.29, 620.33
See application file for complete search history.

(56) References Cited

U.S. PATENT DOCUMENTS 5,171,293 A * 12/1992 Umemoto et al. ..... 439/620.33
5,281,171 A * 1/1994 Job ..... 439/620.26
5,556,305 A * 9/1996 Naegelin ..... 439/620.26
5,662,496 A * 9/1997 Kanamori ..... 493/620.27
5,748,068 A * 5/1998 Kiyota ..... 337/208
6,089,918 A * 7/2000 Arakelian et al. ..... 439/620.27
2001/0027060 A1 10/2001 Kondo et al.
2004/0192113 A1 * 9/2004 Yamashita et al. ..... 439/621

FOREIGN PATENT DOCUMENTS

JP 2001-283711 A 10/2001

* cited by examiner

*Primary Examiner*—Briggitte R Hammond
(74) *Attorney, Agent, or Firm*—Sughrue Mion, PLLC

(57) ABSTRACT

A fuse block is provided. The fuse block includes a fuse box and a plurality of fusible links. The fuse box includes a bottom wall; a plurality of side walls, each side wall extending perpendicular to the bottom wall to define a continuous recess space; and a plurality of guide ribs formed along the side walls and extending in a guide direction which is perpendicular to the bottom wall. The plurality of fusible links are insertable into the continuous recess space, and each fusible link includes a housing, and a plurality of chases formed in the housing and extending in the guide direction. A position of each of the guide ribs within the fuse box corresponds to a position of one of the chases of the fusible links.

17 Claims, 8 Drawing Sheets

FUSE BLOCK

CROSS-REFERENCE TO RELATED APPLICATIONS

This application claims priority from Japanese Patent Application No. 2008-193274 filed on Jul. 28, 2008, the entire subject matter of which is incorporated herein by reference.

TECHNICAL FIELD

Devices and apparatuses consistent with the present invention relate to fuse blocks and, more particularly, to fuse blocks which accommodate a plurality of fusible links.

BRIEF DESCRIPTION OF THE RELATED ART

A related art fuse block, an example of which is shown in FIGS. 7 and 8, includes a plurality of fusible links 110 each of which has a resin housing 110A containing a fuse element. The related art fuse block also includes a fuse box 120 that accommodates the plurality of fusible links 110. The resin housing 110A has a substantially rectangular cross section when viewed in a direction along which the fusible link 110 is inserted into the fuse box 120. The resin housing 110A includes a first pair of flat external side surfaces 111 which faces each other and a second pair of flat external side surfaces 112 which faces each other.

The related art fuse box 120 is divided into a plurality of fuse cavities 121 by a plurality of partition walls 124. In other words, the fuse cavities 121 are arranged so that adjacent fuse cavities 121 share a partition wall 124. The plurality of fusible links 110 are accommodated in the plurality of fuse cavities 121 respectively and arranged in a line such that an external side surface 111 of a housing 110A of a first one of the plurality of fusible links is facing to an external side surface 111 of a housing 110A of another one of the plurality of fusible links that is next to the first one.

Each fuse cavity 121 is provided with a terminal 128 which is provided at a bottom of the fuse cavity 121. The terminal 128 is connected to a terminal of a corresponding one of the fusible links 110 by inserting the fusible link 110 into the corresponding fuse cavity 121 from the top of the fuse box 120.

Thus, as described above, the partition walls 124 are positioned between adjacent fuse cavities 121 and help to position the fusible links 110 when the fusible links 110 are assembled. (see, eg., JP-2001-283711)

However, this structure has some disadvantages. For example, in the related art fuse block, the fuse box 120 is large in size because the fuse box 120 has a partition wall 124 separating the fuse cavities 121. Thus, a pitch P of the fusible links 110 is sum of the width S of the fusible link 110 and the width h of the partition wall 124.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the disadvantages described above.

Accordingly, it is an aspect of the present invention to provide a fuse block which is small in size in the arranging direction of the fusible link without adversely affecting the feasibility of inserting the fusible link into the fuse box.

According to one or more illustrative aspects of the present invention, there is provided a fuse block comprising a fuse box and a plurality of fusible links. The fuse box comprises a bottom wall; a plurality of side walls, each side wall extending perpendicular to the bottom wall to define a continuous recess space; and a plurality of guide ribs formed along the side walls and extending in a guide direction which is perpendicular to the bottom wall. The plurality of fusible links are insertable into the continuous recess space, and each fusible link comprises a housing, and a plurality of chases formed in the housing and extending in the guide direction. A position of each of the guide ribs within the fuse box corresponds to a position of one of the chases of the fusible links.

DETAILED DESCRIPTION OF EXEMPLARY EMBODIMENTS OF THE PRESENT INVENTION

Hereinafter, exemplary embodiments of the present invention will be explained with reference to the drawings.

First Exemplary Embodiment

Figure 1:
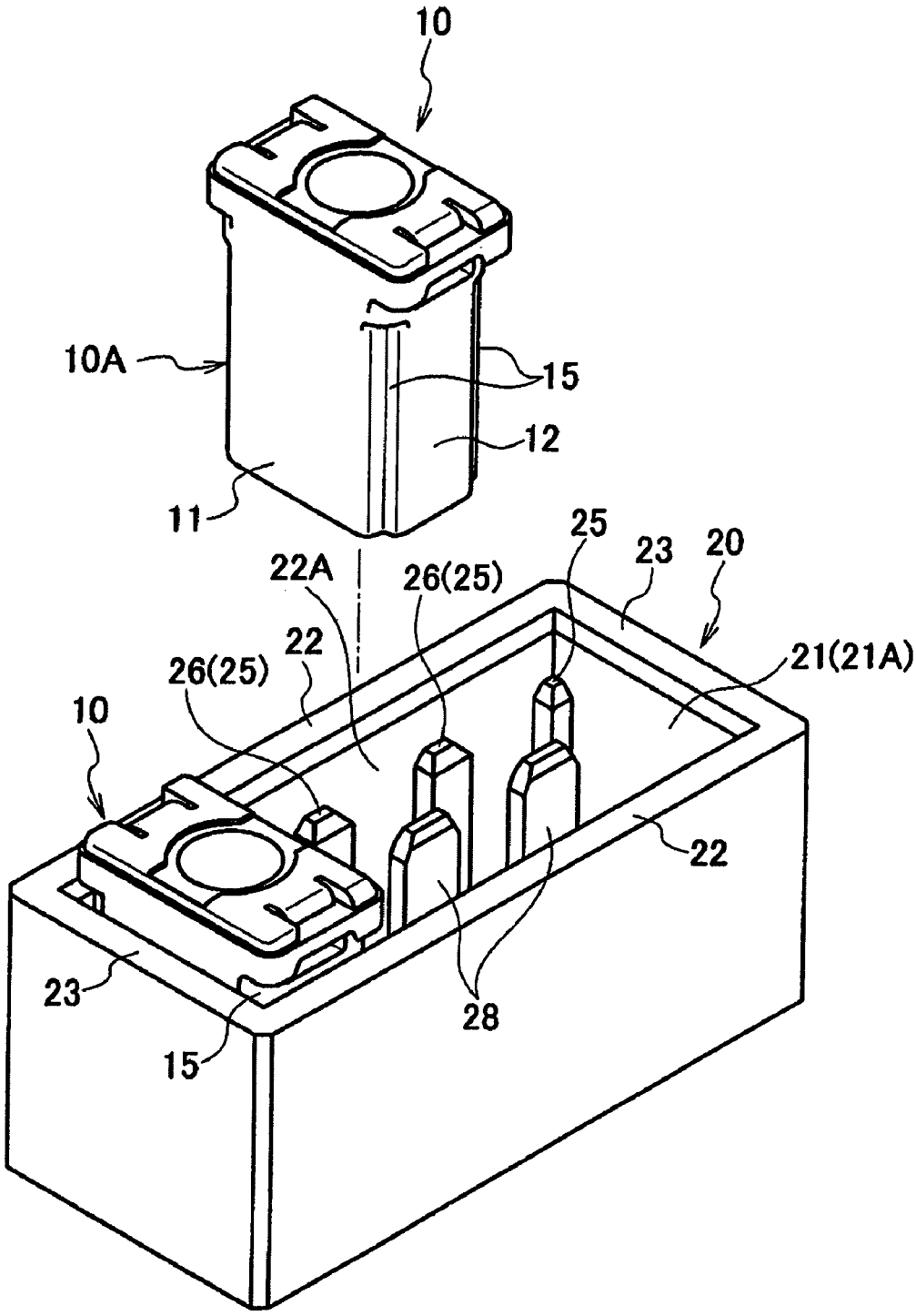
FIG. 1 is a perspective view of a fuse block according to a first exemplary embodiment of the present invention.
Figure 2:
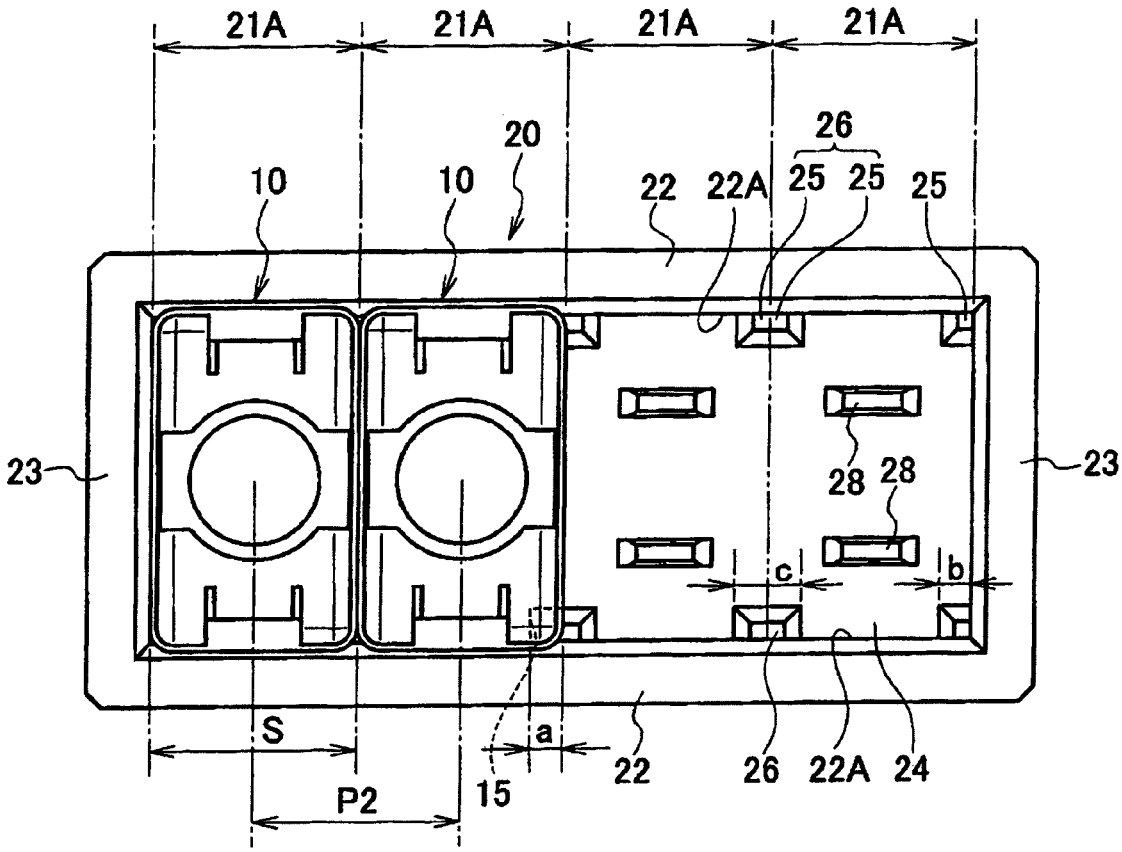
FIG. 2 is a plan view of the fuse block of FIG. 1.
Figure 3A:
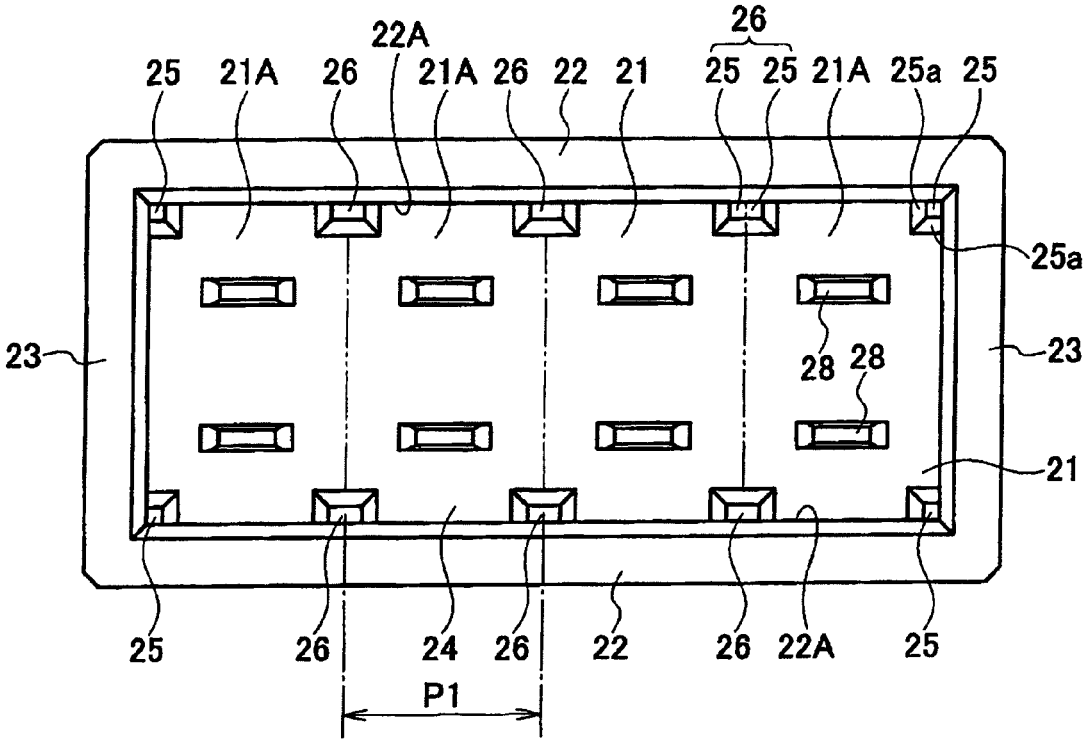
FIG. 3A is a plan view of a fuse box of the fuse block of FIG. 1.
Figure 3B:
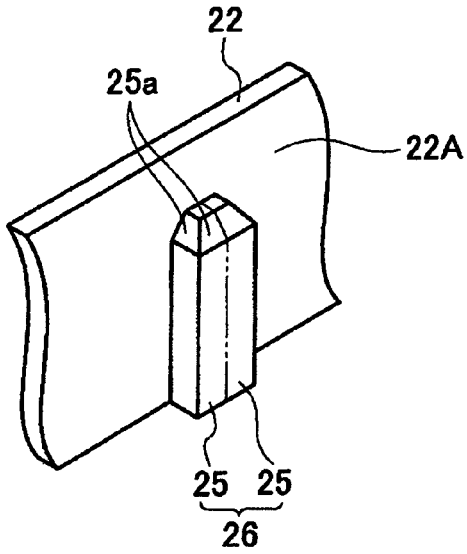
FIG. 3B is an expanded perspective view of a tip of a guide rib of the fuse box of FIG. 3A.

FIG. 1 is a perspective view showing a fuse block according to the first exemplary embodiment of the present invention. FIG. 2 is a plan view of the fuse block of FIG. 1. FIG. 3A is a plan view of a fuse box of the fuse block before the installation of fusible links. FIG. 3B is an expanded perspective view of a tip of a guide rib of the fuse box of FIG. 3A.

Turning to FIG. 1, the fuse block 1 includes a plurality of fusible links 10 each of which has a housing 10A containing a fuse element (not shown). The fuse block 1 also includes a fuse box 20 that accommodates the fusible links 10. The housing 10A of each fusible link 10 has a substantially rectangular cross section when viewed in a direction along which the fusible link 10 is inserted into the fuse box 20. The housing 10A includes a first pair of plane external side surfaces 11 which faces each other and a second pair of plane external side surfaces 12 which faces each other.

The fuse box 20 includes a plurality of fuse cavities 21A to accommodate the plurality of fusible links 10 in a line such that an external side surface 11 of the housing 10A of a first one of the plurality of fusible links is facing to an external side surface 11 of the housing 10A of another one of the plurality of fusible links that is next to the first one.

As shown most clearly in FIG. 3, the fuse cavities 21A are defined in a continuous recess space 21 which is rectangular in plan view and surrounded by a first pair of facing side walls 22, a second pair of facing side walls 23, and a bottom wall 24 so as to form an opening in the top. Each of the first pair of facing side walls 22 and each of the second pair of facing side walls 23 are parallel to each other and perpendicular to the bottom wall 24. In other words, there is no partition wall between the adjacent fuse cavities 21A.

A plurality of guide ribs 25, each of which extends in the direction along which the fusible links 10 are inserted into the fuse cavity 21A, are provided along each of the pair of facing side walls 22. In the first exemplary embodiment, the guide ribs are formed in a polygonal columnar shape. The guide ribs 25 separate the continuous recess space 21 into the plurality of fuse cavities 21A, and define a pair of inner walls 22A for each fuse cavity 21A. Accordingly, the inner walls 22A face each other across the fuse box 20, i.e., in a direction perpendicular to the direction along which the fusible links 10 are arranged in the recess space 21.

As shown in FIG. 1, a plurality of chases 15 are provided on the housing 10A of each fusible link 10. For each fusible link 10, the chases 15 are provided on the four corners of the housing 10A of the fusible link 10 and extend in a direction parallel to the direction in which the fusible link 10 is inserted into the fuse box 20. Each chase 15 corresponds to one of the guide ribs 25 that are provided along the side walls 22 of housing 10A. In the first exemplary embodiment, the guide ribs 25 are provided at each of the four corners of each fuse cavity 21A.

Since in the first exemplary embodiment the guide ribs 25 are provided on the four corners, respectively, of each cavity 21A, a guide rib provided along a side of a fusible link 10 that faces an adjacent fusible link 10 will be adjacent to a corresponding one of the guide ribs of the adjacent fusible links. Accordingly, the adjacent guide ribs of the two fuse cavities 21A which are adjacent to each other are formed into a double wide guide rib 26 that spans a boundary of the adjacent two cavities 21A, as shown in FIGS. 3A and 3B.

As shown in FIG. 2, the width b of each guide rib 25 is set so as to be substantially equal to the width a of a chase, and the width c of each of the double wide guide ribs 26 is set so as to be twice the width b of the guide rib 25. Thus, a pitch P1 of the double wide guide ribs 26 in the arranging direction of the fusible links is substantially equal to the width S of a housing 10A of a fusible link 10. Accordingly, the alignment pitch P2 of the fusible links 10 is substantially equal to the width S of a housing 10A of a fusible link 10.

Additionally, as shown in FIG. 3B, each guide rib 25 includes a guide leading portion 25*a* provided at a portion of the guide rib 25 which first contacts with the chase 15 of the corresponding fusible link 10 when the fusible link 10 is inserted into the fuse cavity 21A. In the first exemplary embodiment, the guide leading portion 25*a* is a beveled shape at the tip of the guide rib 25 (the end which first contacts a fusible link). Thus, the guide leading portion 25*a* assists in guiding the guide rib 25 into the chase 15 of a corresponding fusible link 10 which is to be inserted. Alternatively, each of the chases 15 on the fusible link 10 may be formed as a horn shape expanding portion at the end of the chase 15 that first contacts the guide rib 25 of the corresponding fuse cavity 21A into which the fusible link 10 is to be inserted. In other words, the chase 15 is flared out at the end which first contacts the corresponding guide rib 25. In this alternative structure, the guide rib 25 is not provided with the guide leading portion 25*a*, and the horn shaped expanding portion serves as the guide leading portion. Further, both the guide leading portion 25*a* on the guide ribs 25 and the horn shape expanding portion on the chases 15 be provided in combination.

As shown in FIG. 3A, each fuse cavity 21A includes a plurality of terminals 28 which extend parallel to the facing side walls 22 and guide ribs 25. Accordingly, when a fusible link 10 is inserted from the top side of the fuse block into a corresponding one of the fuse cavities 21A, the terminals 28 provided at the bottom of the fuse cavity 21A (bottom wall 24) are inserted into corresponding terminals (not shown) in the fusible link 10 to establish an electrical connection.

As described above, the fuse block 1 of the first exemplary embodiment is configured such that a fusible link 10 is inserted into the fuse box 20 while the chases 15 of the fusible link 10 are guided by and fitted to the guide ribs 25 of a corresponding one of the fuse cavities 21A. Therefore, it is possible to insert the fusible link 10 into the fuse box 20 smoothly without using a partition wall between the adjacent fuse cavities 21A.

Accordingly, a user need not use the terminals 28 to align and insert the fusible link 10 into the fuse cavity 21A. Instead, the user can more easily assemble the fusible link 10 at a correct position and can more smoothly connect the terminals of the fusible link 10 with the terminals 28 of the fuse box 20. Since the guide leading portion 25*a* is provided at the portion at which the guide rib 25 is first contacted with the chase 15, the guide rib 25 is more easily fitted into the chase 15.

As the partition walls between the fuse cavities are omitted by defining a plurality of fuse cavities 21A in the continuous recess space 21, it is possible to reduce the pitch P2 of the fusible link 10 by an amount equal to the combined width of the partition walls. Therefore, the size of the fuse block in the arranging direction of the fusible links 10 is reduced, and miniaturization and weight saving are achieved. Additionally, moldability of the fuse box 20 is improved because the partition wall is omitted.

Figure 4:
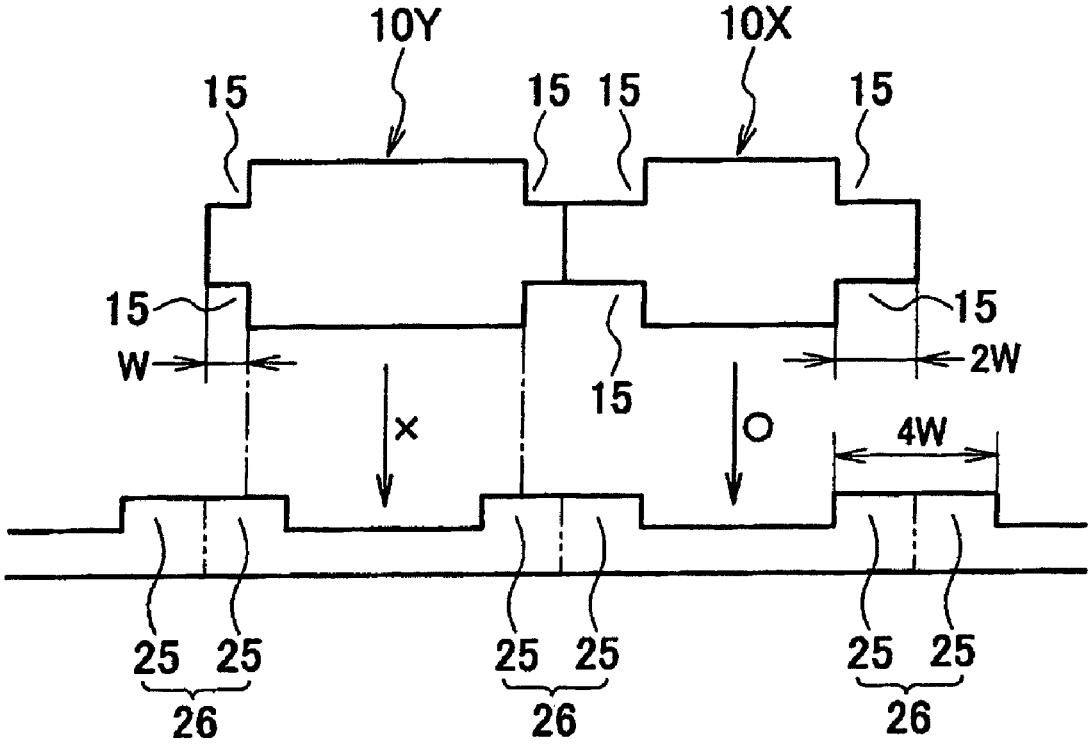
FIG. 4 is a plan view showing a relationship between the guide rib of the fuse box and a chase of a fusible link of the fuse block of FIG. 1.

As shown in FIG. 4, the guide ribs 25 and the chases 15 allow for increased control over a type or current rating of fusible link to be used with a given fuse box. For example, the dimensions of the guide ribs 25 and the chases 15 for use with a fusible link 10X (e.g., a 20 ampere type link) may be set to be different from the dimensions of the guide ribs 25 and the chases 15 for a different fusible link 10Y (e.g., a 80 ampere type link).

For example, as shown in FIG. 4, the width of the double wide rib 26 is set to be 4 W in accordance with a width of the chase 15 of 2 W so that only the chase 15 of the fusible link of 10X (e.g., a 20 ampere type) can be fitted to the double wide rib 26, and the width of the chase of the fusible link of 10Y (e.g., an 80 ampere type) is set to be W. Accordingly, the 20 ampere fusible link 10X is able to be inserted because the chases 15 of both ends are fitted into the corners of the double wide ribs 26 (i.e., corresponding to the guide rib 25) at both sides (see "○" in FIG. 4). On the other hand, the 80 ampere fusible link 10Y is not able to be inserted. Therefore, insertion of an improperly rated fusible link is prevented.

In the first embodiment, the chases 15 are provided at the four corners of the housing 10A of the fusible link 10, and the guide ribs 25 are fitted into the chases 15. Because the chases are provided at the corners, it is possible to easily position the chases 15 and the guide ribs 25 and to smoothly insert the fusible link 10 into the fuse box 20.

Additionally, since corresponding guide ribs 25 of two adjacent fuse cavities 21A are formed into the double wide guide rib 26, it is possible to reduce the number of the guide ribs and thus to improve workability.

Additionally, because the width dimensions b, c, and a for the guide rib 25, the double wide guide rib 26 and the chase 15, respectively, are set as described above, the plurality of fusible links 10 are able to be accommodated in the fuse box 20 and arranged in a line without spaces inbetween adjacent fusible links 10. Thus, the dimension in the direction along which the fusible links are arranged maybe reduced.

Second Exemplary Embodiment

Figure 5A:
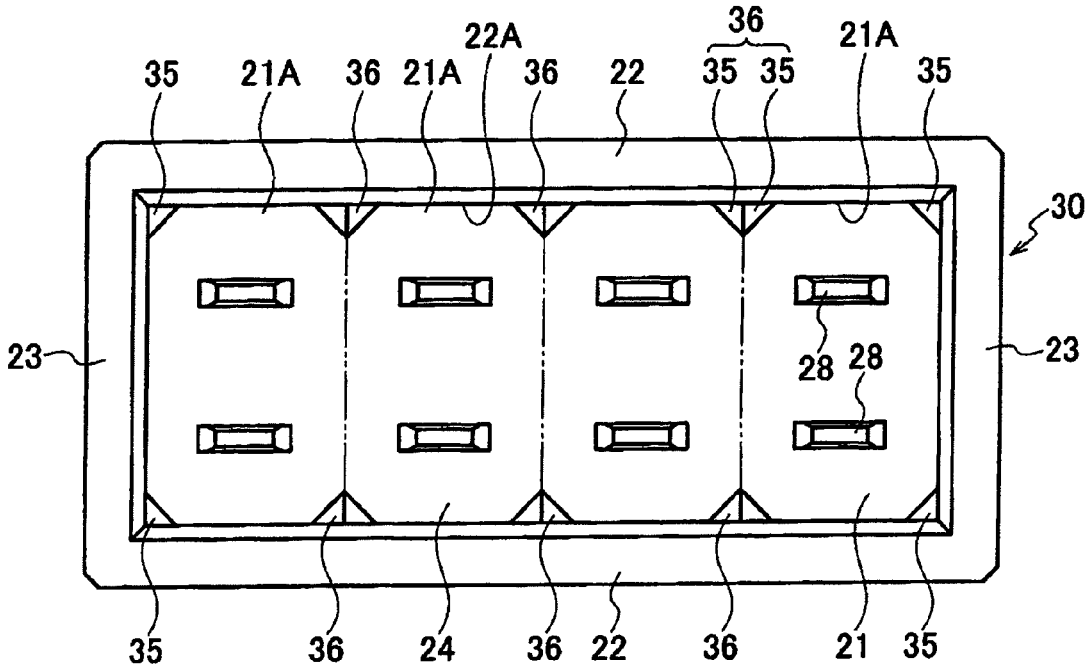
FIG. 5A is a plan view of a fuse box according to a second exemplary embodiment of the present invention.
Figure 5B:
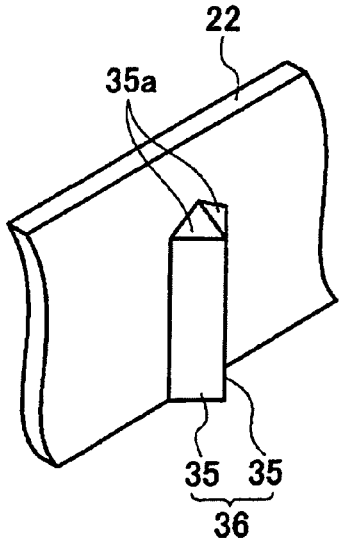
FIG. 5B is an expanded perspective view showing a tip of a guide rib of the fuse box of FIG. 5A.

In the above described first exemplary embodiment, guide ribs 25 having a polygonal columnar shape are provided in the fuse box 20. However, in FIGS. 5A and 5B, a fuse box 30 according to a second exemplary embodiment of the present invention is shown. The fuse box 30 according to the second exemplary embodiment includes guide ribs 35 and a double wide guide ribs 36, each having a triangle columnar shape. Each of the guide ribs 35 and each of the double wide guide ribs 36 include a guide leading portion 35*a* having a beveled shape. However, the cross sectional shape of the guide rib is not particularly limited.

Third Exemplary Embodiment

In the above described first and second exemplary embodiments of the present invention, the guide ribs of each fuse cavity are provided so as to correspond to the chases provided on the four corners of the housing of a fusible link which will be inserted into the fuse cavity. However, according to a third exemplary embodiment of the present invention, the guide ribs may be provided only at two opposing corners of each fuse cavity 21A.

Figure 6:
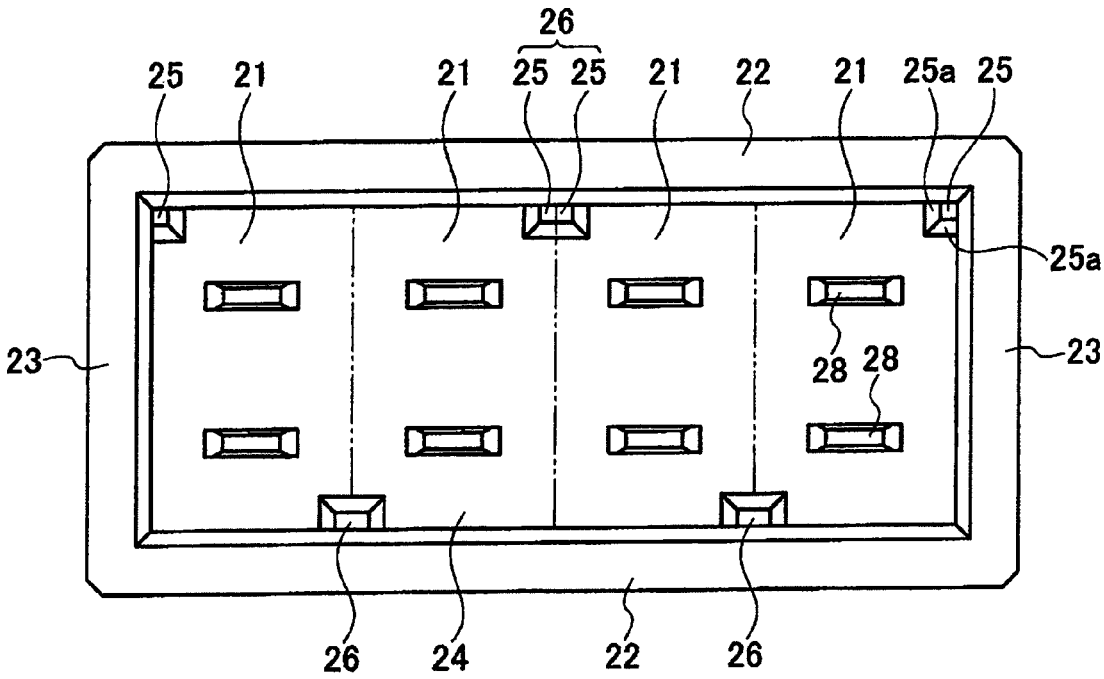
FIG. 6 is a plan view of a fuse box according to a third exemplary embodiment of the present invention.
Figure 7:
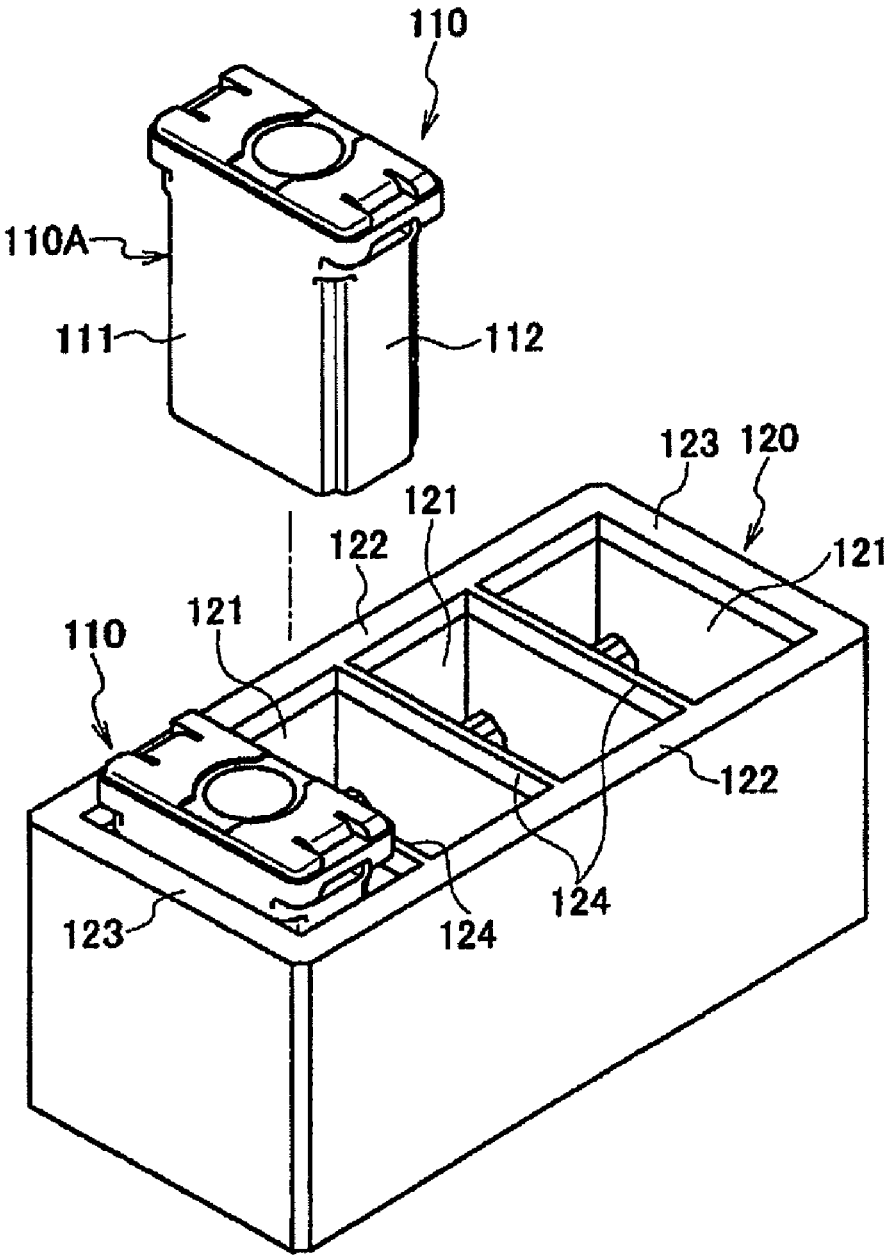
RELATED ART FIG. 7
FIG. 7 is a perspective view showing a related art fuse block.
Figure 8:
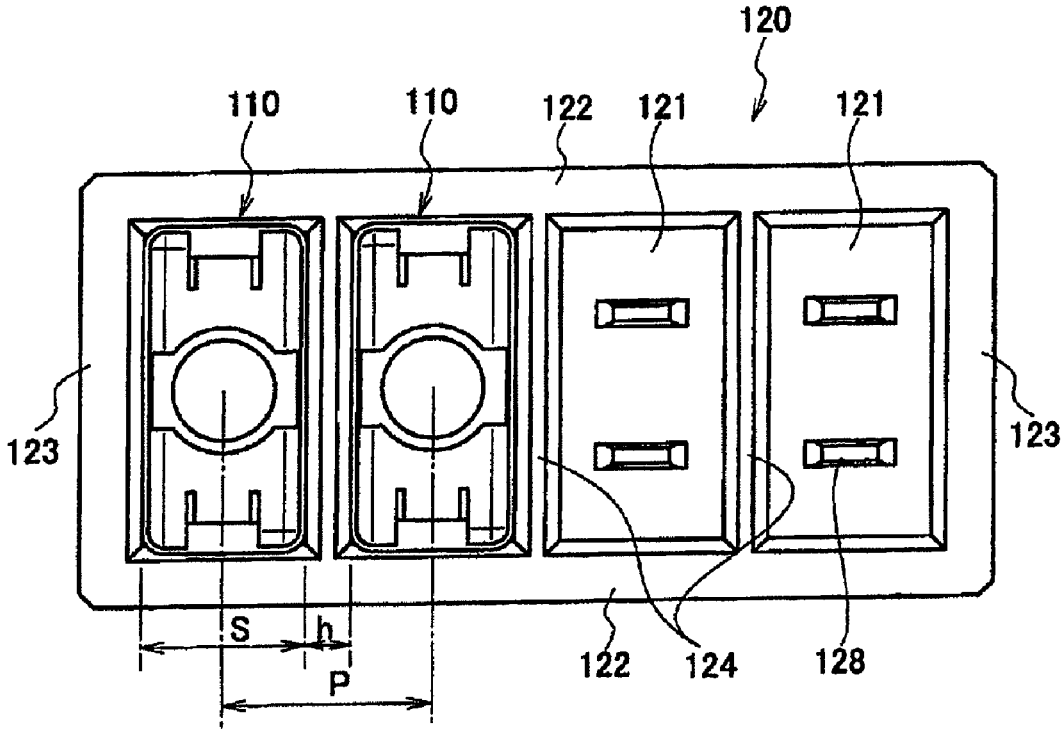
RELATED ART FIG. 8
FIG. 8 is a plan view showing the related art fuse block of FIG. 7.

Accordingly, as shown in FIG. 6, a fuse box 40 according to the third exemplary embodiment includes guide ribs 45 and double wide guide ribs 46. As in the previous exemplary embodiments, each of the double wide guide ribs 46 is formed from guide ribs 45 of two adjacent fuse cavities 21A. However, in the third exemplary embodiment, the guide ribs 45 and the double wide guide ribs 46 are arranged in a zig-zag pattern (i.e., a hound's tooth arrangement) across the fuse box 40 in the direction in which the fusible links are arranged in the fuse box 40. In other words, the guide ribs 45 and double wide ribs 46 are alternately provided on the facing inner walls of the recess space 21 in a zigzag arrangement. Thereby, by using the fuse box 40 according to the third exemplary embodiment of the present invention, it is possible to guide the fusible links while using fewer guide ribs. It should be noted that a fusible link according to the third exemplary embodiment may have four chases, or may have two chases at opposite corners to correspond to the position of the guide ribs 45 and double wide guide ribs 46.

Additional Modifications

In the above described exemplary embodiments, the chases are provided at the corners of the housing of the fusible link. However, alternatively, the chases may be provided at positions different from the corners as long as the guide ribs are provided at positions which correspond to the positions of the chases.

According to one or more illustrative aspects of the present invention, there is provided a fuse block comprising a fuse box including side walls, a bottom wall which has a terminal, a continuous recess space defined by the side walls and the bottom wall, an opening defined by the side walls, and a guide rib along the side walls and extending in an insertion direction from the bottom wall to the opening; and a plurality of fusible links each of which is inserted into the continuous recess space and includes a housing having a substantially rectangular shape in a transverse cross section, a terminal to be connected to a terminal of the fuse box, and chases provided on the housing and extending in the insertion direction. The chases of the fusible link are fitted to corresponding ones of the guide ribs when the fusible link is inserted into the continuous recess portion.

Each of the guide ribs may include a guide leading portion at a portion of the guide rib which is firstly contacted with the chase.

The chases may be provided at at least on two opposing corners of the cross section of the housing, and the guide ribs may be provided so as to correspond to the chases.

Corresponding guide ribs of two adjacent fuse cavities may be formed as a double wide rib.

A width of each of the guide ribs may be set so as to be equal to a width of a corresponding one of the chases, a width of each of the double wide guide ribs may be set so as to be twice the width of the guide ribs, and an alignment pitch of the double wide guide ribs is set so as to be substantially equal to a width of the housing of a fusible link.

The double wide guide ribs may be alternately provided on the side walls in a zig-zag arrangement.

According to the exemplary embodiments of the present invention, the fusible link is inserted into the fuse box while the chases formed on the housing of the fusible link are fitted into corresponding ones of the guide ribs of the fuse box. Accordingly, because of the guidance by the guide rib, it is possible to smoothly insert the fusible link into the fuse box without a partition wall between the fuse cavities. Moreover, the fusible link may be inserted without aiming at the terminals of the fuse cavity. Instead, it is possible to easily assemble the fusible link at a correct position and to smoothly connect the terminals of the fusible link and the terminals of the fuse cavity. Moreover, since the guide leading portion is provided at the portion where the guide rib is firstly contacted with the chase, the guide rib and the chase are easily fitted together.

Additionally, as the partition walls between adjacent ones of the fuse cavities are omitted, it is possible to reduce the pitch of the fusible links by an amount of the partition wall width. Therefore, the dimension of the fuse block in the direction of the fusible link alignment is reduced, and miniaturization and weight saving are achieved. Additionally, the fuse box may be more easily formed during a resin molding process because the partition wall is omitted. Also, by setting the dimensions of the guide ribs and the chases for different types and/or ratings of fusible links, a mismatch in connection of the fusible links to the fuse box may be prevented.

Additionally, in the case in which the chase is provided at only two opposing corners of the four corners of the cross section of the housing of the fusible link and the chases are fitted into the guide ribs, it is possible to position the fusible links and smoothly insert the fusible links into the fuse box. Additionally, since only two guide ribs are provided in each fuse cavity, it is possible to reduce the number of the ribs and increase workability.

According to the exemplary embodiments of the present invention, the plurality of fusible links are able to be accommodated in the fuse box within aligned condition without spaces therebetween. Thus, the dimension in the direction along which the fusible links align may be decreased.

In the case in which the guide ribs are arranged in a zig-zag arrangement, it is possible to achieve suitable guidance with the least number of the guide ribs.

While the present invention has been shown and described with reference to certain exemplary embodiments thereof, it will be understood by those skilled in the art that various changes in form and details may be made therein without departing from the spirit and scope of the invention as defined by the appended claims.

The invention claimed is:

1. A fuse block comprising:

a fuse box comprising:

a bottom wall;

a plurality of side walls, each side wall extending perpendicular to the bottom wall to define a continuous recess space; and a plurality of guide ribs formed on the side walls and extending in a guide direction which is perpendicular to the bottom wall; and a plurality of fusible links, which are insertable into the continuous recess space, each fusible link comprising a housing, and a plurality of chases formed in the housing and extending in the guide direction, wherein a position of each of the guide ribs within the fuse box corresponds to a position of one of the chases of the fusible links.

2. The fuse block according to claim 1, wherein a width of each of the guide ribs is the same, a width of each of the chases is the same, and a width of the guide rib is substantially equal to the width of the chase.

3. The fuse block according to the claim 1, wherein the fusible links are arranged in a line such that an outer surface of the housing of a first one of the plurality of fusible links faces to an outer surface of the housing of another one of the plurality of fusible links.

4. The fuse block according to claim 1, wherein the fusible links are arranged in the continuous recess space such that facing side walls of adjacent ones of the plurality of fusible links touch each other.

5. The fuse block according to claim 1, wherein each of the plurality of chases comprises a horn shape expanding portion provided at a distal end of the chase.

6. The fuse block according to claim 1, wherein each of the fusible links comprises an electrical terminal, and the fuse box further comprises a plurality of terminals corresponding to the plurality of fusible links, wherein when the plurality of fusible links are inserted into the fuse box, the electrical terminal of each fusible link is electrically connected to a corresponding one of the plurality of terminals of the fuse box.

7. The fuse block according to claim 1, wherein each of the guide ribs comprises a guide leading portion at a distal end thereof.

8. The fuse block according to claim 7, wherein the guide leading portion is a beveled tip.

9. The fuse block according to claim 7, wherein the guide leading portion is a tapered tip.

10. The fuse block according to claim 1, wherein the plurality of guide ribs define a plurality of fuse cavities within the continuous recess space, each fuse cavity corresponding to one of the plurality of fusible links, and each fuse cavity comprising at least two of the plurality of guide ribs.

11. The fuse block according to claim 10, wherein the housing of each of the plurality of fusible links comprises two chases positioned at opposing corners of the housing.

12. The fuse block according to claim 10, wherein at least one guide rib of a first fuse cavity of the plurality of fuse cavities is adjacent to at least one guide rib of a second fuse cavity of the plurality of fuse cavities that is adjacent to the first fuse cavity, and each pair of adjacent guide ribs is integrally formed together into a spanning guide rib that spans the boundary of the first fuse cavity and the second fuse cavity.

13. The fuse block according to the claim 10, wherein:

a guide rib of a first fuse cavity of the plurality of fuse cavities is adjacent to a guide rib of a second fuse cavity of the plurality of fuse cavities that is adjacent to the first fuse cavity, and the adjacent guide ribs are integrally formed together into a spanning guide rib that spans the boundary of the first fuse cavity and the second fuse cavity, and a second guide rib of the second fuse cavity is adjacent to a guide rib of a third fuse cavity that is adjacent to the second fuse cavity, the ribs being integrally formed together so as to form a second spanning guide rib, and the spanning guide rib and the second spanning guide rib are formed on opposite side walls of the fuse box.

14. The fuse bock according to claim 13, wherein the spanning guide rib and the second panning guide rib are located, respectively, on side walls that oppose each other.

15. A fuse box comprising:

a bottom wall;

a plurality of side walls, each side wall extending perpendicular to the bottom wall to define a continuous recess space;

a plurality of guide ribs formed along the side walls within the continuous recess space, and each of the guide ribs extending in a guide direction which is perpendicular to the bottom wall; and at least one spanning guide rib formed along the side walls within the continuous recess space and extending in the guide direction, wherein each of the guide ribs has a same width, and a width of the spanning guide rib is substantially equal to twice the width of a guide rib.

16. The fuse box according to claim 15, wherein the plurality of guide ribs and the at least one spanning guide rib together define a plurality of fuse cavities within the continuous recess space, and wherein the at least one spanning guide rib spans a boundary between fuse cavities that are adjacent to each other.

17. The fuse box according to claim 16, wherein the at least one spanning guide rib comprises two spanning guide ribs, and the two spanning guide ribs are located, respectively, on two of the plurality of side walls which are opposite each other.

* * * * *